US008635815B2

(12) United States Patent
Bordin

(10) Patent No.: US 8,635,815 B2
(45) Date of Patent: Jan. 28, 2014

(54) LEVELING SPACER FOR LAYING WALL TILES, PAVING TILES AND THE LIKE WITH THE INTERPOSITION OF GAPS

(71) Applicant: Progress Profiles SPA, Frazione Casella (IT)

(72) Inventor: Lino Bordin, Maser (IT)

(73) Assignee: Progress Profiles SpA (IT)

( * ) Notice: Subject to any disclaimer, the term of this patent is extended or adjusted under 35 U.S.C. 154(b) by 0 days.

(21) Appl. No.: 13/622,624

(22) Filed: Sep. 19, 2012

(65) Prior Publication Data

US 2013/0067854 A1 Mar. 21, 2013

(30) Foreign Application Priority Data

Sep. 20, 2011 (IT) ..... PD2011A0295

(51) Int. Cl.
*E04B 2/82* (2006.01)
*E04B 9/00* (2006.01)
*E04G 1/22* (2006.01)

(52) U.S. Cl.
USPC ..... 52/126.1; 52/749.11; 52/747.11; 52/DIG. 1; 52/127.7; 52/126.4; 52/389; 52/392; 33/526; 33/533

(58) Field of Classification Search
USPC ..... 52/396.1, 126.1, 126.4, 126.7, DIG. 1, 52/391, 392, 747.11, 749.11, 396.08, 390, 52/389, 127.1, 746.12, 127.7; 33/526, 33/527, 567, 567.1, 613, 645; 411/538, 411/537, 546
See application file for complete search history.

(56) References Cited

U.S. PATENT DOCUMENTS

| | | | | |
|---|---|---|---|---|
| 4,397,125 | A * | 8/1983 | Gussler, Jr. | 52/127.3 |
| 7,257,926 | B1 * | 8/2007 | Kirby et al. | 52/126.5 |
| 7,621,100 | B2 * | 11/2009 | Kufner et al. | 52/749.11 |
| 7,861,487 | B2 * | 1/2011 | Kufner et al. | 52/749.11 |
| 7,954,300 | B1 * | 6/2011 | Kufner et al. | 52/749.11 |
| 7,992,354 | B2 * | 8/2011 | Doda, Jr. | 52/127.7 |
| 8,011,164 | B2 * | 9/2011 | Kufner et al. | 52/749.11 |
| 8,099,926 | B2 * | 1/2012 | Kufner et al. | 52/749.11 |
| 8,181,420 | B2 * | 5/2012 | Torrents I Comas | 52/749.11 |
| 8,336,279 | B2 * | 12/2012 | Kufner et al. | 52/749.11 |
| 2002/0157339 | A1 * | 10/2002 | Repasky | 52/506.06 |
| 2006/0185319 | A1 * | 8/2006 | Kufner et al. | 52/749.11 |

FOREIGN PATENT DOCUMENTS

| | | | |
|---|---|---|---|
| EP | 2330261 | A1 | 6/2011 |
| FR | 2881761 | A1 | 8/2006 |
| WO | 2009022359 | A1 | 2/2009 |

OTHER PUBLICATIONS

European Search Report for corresponding European application No. 12184701.6, Mail date Oct. 15, 2012.

* cited by examiner

*Primary Examiner* — Chi Q Nguyen
(74) *Attorney, Agent, or Firm* — Cantor Colburn LLP

(57) ABSTRACT

A leveling spacer for laying wall tiles, paving tiles and the like with the interposition of gaps, which comprises a base with spacing protrusions for the abutment of the edges of corresponding tiles so as to define the width of the gaps, a threaded stem, which is fixed at right angles to the base in at least one easily breakable point, a knob for clamping and removing the threaded stem, which comprises a female threaded portion adapted to be screwed to the threaded stem.

9 Claims, 3 Drawing Sheets

LEVELING SPACER FOR LAYING WALL TILES, PAVING TILES AND THE LIKE WITH THE INTERPOSITION OF GAPS

The present invention relates to a leveling spacer for laying wall tiles, paving tiles and the like with the interposition of gaps.

BACKGROUND OF THE INVENTION

Laying floors and claddings composed of wall tiles, paving tiles or medium and large slabs with reduced or lowered thickness typically presents major difficulties in the steps of planarization of the laying and of equal spacing of the tiles in order to define the gaps.

At present, leveling spacers are known for laying wall tiles, paving tiles and the like which are constituted by a base, which is arranged below two tiles that are side by side. From such base spacing protrusions extend, which are substantially shaped like parallelepipeds, so as to define the width of the gaps. Such spacing protrusions in fact define abutments for the edges of the tiles.

By arranging, for example, two leveling spacers at each side of a tile, preferably proximate to each one of the corner edges, the desired levelness is obtained for such tile, and at the same time the correct positioning is sought with respect to the tiles that surround it and that are also laid with other, identical leveling spacers.

From the base of the leveling spacer a flat tab extends, which extends out of the channel formed between the tiles which defines the gap, and is provided with an opening for the insertion, between the surface of the tile and the upper edge of the opening itself, of a tile immobilization wedge.

Such wedge immobilization system has two functions.

A first function is to immobilize the edges of the adjacent tiles between the wedge and the base of the leveling spacer, thus ensuring a coplanar arrangement during the laying of the tiles. The second function is to enable the removal of the tabs from the respective bases when the gaps are to be defined.

In fact by striking the wedge in the direction of insertion in the opening, said tab is torn from its base.

Another, similar leveling spacer device has, extending from the base with spacers, a perforated strap-like tenon, which is designed to be inserted in an immobilizing body which in turn is adapted to be pressed so as to straddle the two laterally adjacent edges of the neighboring tiles.

Such leveling spacers, although widespread and appreciated, are not devoid of drawbacks.

For the first type of leveling spacer, which uses a wedge for immobilization and removal, a main drawback consists in that the removal of the tab by way of striking the wedge is not simply and immediately executed, because the system, although purportedly designed to effect the striking action on the wedge by way of one or more kicks delivered with the toe of a foot, in practice requires a special and very specific intervention with a hammer, and such intervention is relatively slow in execution when evaluated in its entirety, i.e. considering that it has to be repeated for all the leveling spacers used for laying an entire floor.

Moreover it has been found that striking the wedges in a direction parallel to the arrangement of the tiles can cause an unwanted shifting of the tiles themselves, which are pushed by the tab which in turn is driven by the struck wedge.

For the second type of leveling spacer described above, which uses a strap, the main drawback is linked to the fact that the correct and useful coupling between the strap and the immobilizing body for immobilizing the tiles between the immobilizing body and the base of the spacer is to be achieved by means of an adapted utensil for thrust and traction, which is designed especially to hold the strap and at the same time push the immobilizing body against the tiles.

Such use of an adapted utensil requires the availability of the utensil itself, and a certain period of time both for laying and for removal, since the same utensil is used for the removal of the strap from the base by traction of the strap.

SUMMARY OF THE INVENTION

The aim of the present invention is to provide a leveling spacer for laying wall tiles, paving tiles and the like with the interposition of gaps, which is capable of overcoming the drawbacks exhibited by the conventional leveling spacers.

Within this aim, an object of the invention is to provide a leveling spacer that is easy and intuitive to use both in the step of assembly for the immobilization of the tiles, and in the step of removal for the subsequent filling of the gaps.

Another object of the invention is to provide a leveling spacer that can be used without subjecting the tiles to an unwanted lateral thrust that risks affecting the correct positioning thereof.

A further object of the invention is to provide a leveling spacer that can be applied without the use of specially-made utensils.

Another object of the invention is to provide a leveling spacer for laying wall tiles, paving tiles and the like with the interposition of gaps, that can be made using known systems and technologies.

This aim and these and other objects which will become better evident hereinafter are achieved by a leveling spacer for laying wall tiles, paving tiles and the like with the interposition of gaps, characterized in that it comprises

- a base with spacing protrusions for the abutment of the edges of corresponding tiles so as to define the width of the gaps,
- a threaded stem which is fixed at right angles to the base in at least one easily breakable point,
- a knob for clamping and removing the stem, which comprises a female threaded portion which is adapted to be screwed to said stem.

BRIEF DESCRIPTION OF THE DRAWINGS

Further characteristics and advantages of the invention will become better apparent from the description of three preferred, but not exclusive, embodiments of the leveling spacer according to the invention, which are illustrated by way of non-limiting example in the accompanying drawings wherein.

DESCRIPTION OF THE PREFERRED EMBODIMENTS

Figure 1:
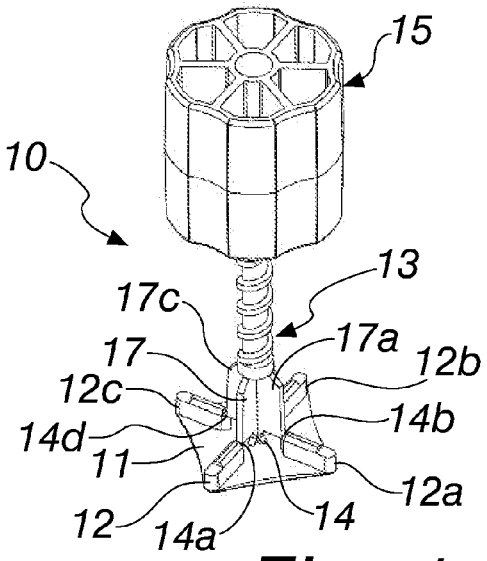
FIG. 1 is an exploded perspective top view of a leveling spacer according to the invention.
Figure 2:
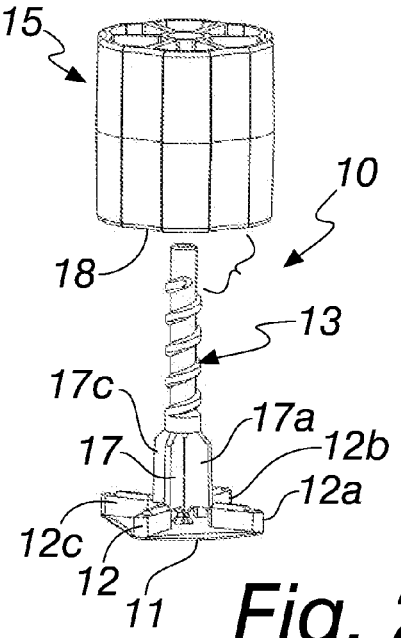
FIG. 2 is another exploded perspective view of the invention, from below.
Figure 3:
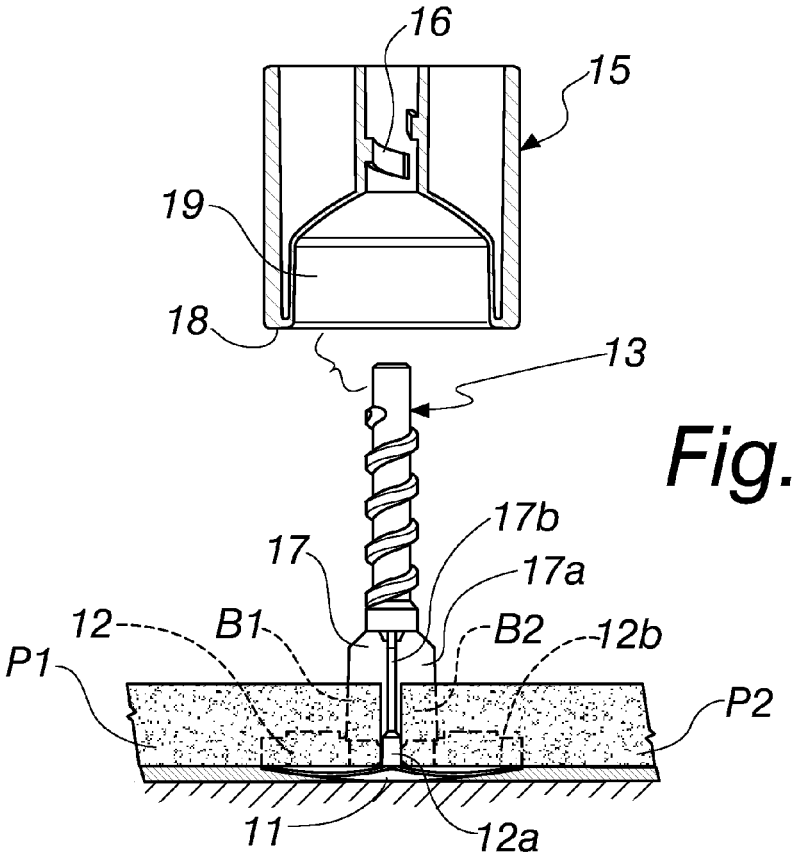
FIG. 3 is a sectional side view of the spacer according to the invention in a step of assembly.
Figure 4:
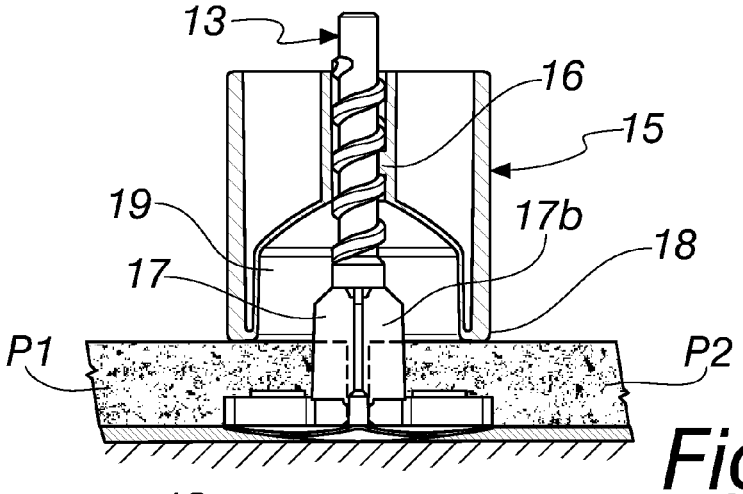
FIG. 4 is a sectional side view of the spacer according to the invention in a first step of use.
Figure 5:
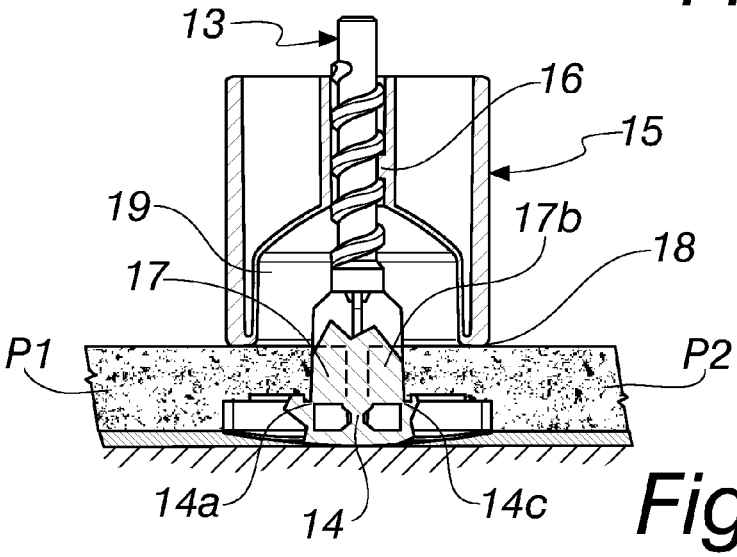
FIG. 5 is a view similar to the previous view but with the base and stem shown clearly in cross-section.
Figure 6:
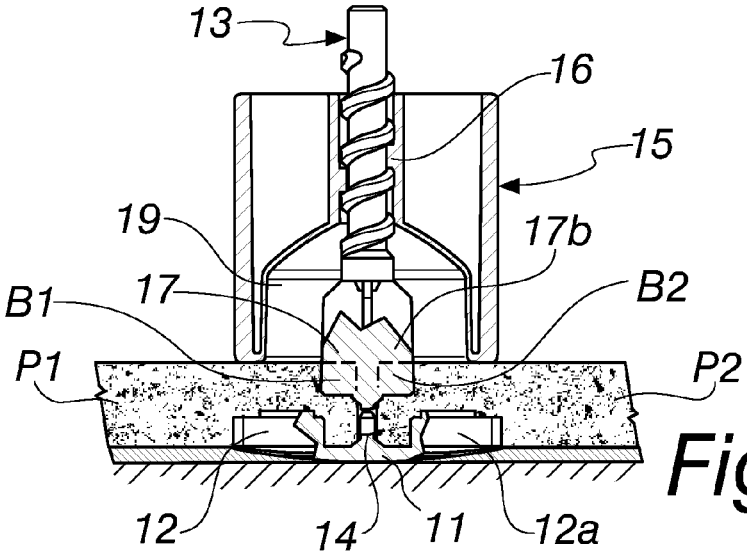
FIG. 6 is a sectional side view as in FIG. 5 of the spacer according to the invention in a second step of use.

With reference to the figures, a leveling spacer for laying wall tiles, paving tiles and the like with the interposition of gaps, is generally designated with the reference numeral 10.

Two generic tiles, schematically shown, in FIGS. 3 to 6, are designated with P1 and P2 and do not form part of the subject matter of the invention.

The edges of the tiles P1 and P2 are designated respectively with B1 and B2.

Such leveling spacer 10 comprises a base 11, which is to be arranged below the corner edges of four tiles.

From such base 11 four spacing protrusions 12, 12*a*, 12*b* and 12*c* extend for the abutment of the edges B1 and B2 of corresponding tiles, two of which, P1 and P2, are exemplified in FIGS. 3 to 6, in order to define the width of the gaps.

The leveling spacer 10 also comprises a threaded stem 13 which is fixed at right angles to the base 11 in a series of easily breakable points 14, 14*a*, 14*b*, 14*c* and 14*d*.

Such easily breakable points correspond, in such embodiment, to a first central point 14 and to four lateral points 14*a*, 14*b*, 14*c* and 14*d*, each of which is defined by a joint between a spacing protrusion 12, 12*a*, 12*b* and 12*c* and a corresponding wing 17, 17*a*, 17*b* and 17*c* which protrudes radially from the threaded stem 13.

The easily breakable points 14, 14*a* are understood to be sufficiently thin, i.e. of reduced thickness, to be breakable following a traction of minor extent and in any case achievable with the means described below.

The leveling spacer 10 according to the invention comprises a knob 15 for clamping and removing the threaded stem 13, which comprises a female threaded portion 16 adapted to be screwed to the threaded stem 13.

The knob 15 has a flat part 18 which is designed to be pressed against the tiles, in a first step of laying the tiles, for immobilizing the edges and corners of a plurality of tiles arranged on the base 11.

The knob 15 is provided internally with a compartment 19 that is defined so that the body of the knob 15, in use, does not interfere with the wings 17, 17*a*, 17*b* and 17*c* which extend from the threaded stem 13.

A second step of use of the knob 15, to be carried out once the fixing of the tiles to the underlying surface is complete, involves the removal of the threaded stem 13 by further rotation of the knob 15 to screw it on the threaded stem 13.

In fact, such further rotation of the knob 15 in the same direction of screwing causes the traction in a direction that is perpendicular to the arrangement of the tiles P1 and P2 of the threaded stem 13, until the breakage points 14, 14*a*, 14*b* and 14*d* break, with consequent removal of the stem 13 and of its wings 17, 17*a*, 17*b* and 17*c* from the base 11.

The base 11 is embedded and hidden by the grouting with which the gaps between the wall tiles are filled.

Figure 7:
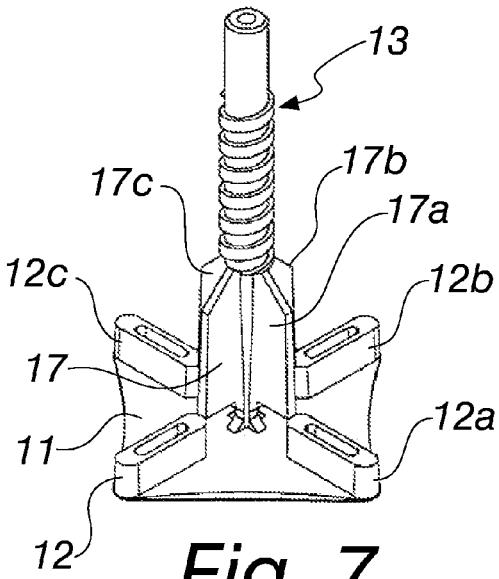
FIGS. 7 to 9 each show an embodiment of a detail of the spacer according to the invention.

FIG. 7 shows the embodiment of the base 11 with four spacing protrusions 12, 12*a*, 12*b* and 12*c*, equidistant, designed to be arranged below four converging corners of a corresponding number of tiles.

Figure 8:
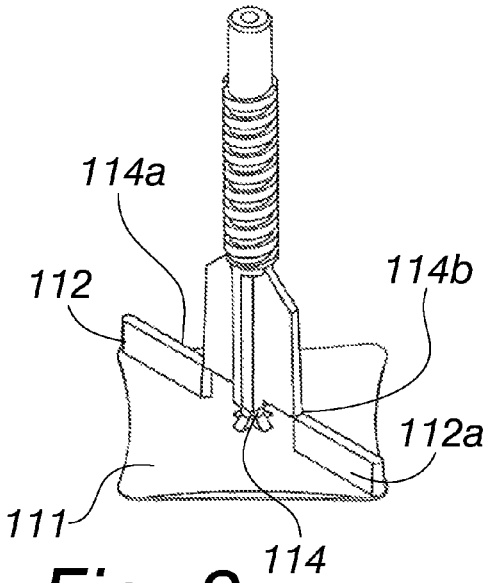

FIG. 8 shows a second embodiment of a base 111, with two spacing protrusions 112 and 112*a*, and thus with three breakage points 114, 114*a* and 114*b* , designed to be arranged below two laterally adjacent sides of two tiles.

Figure 9:
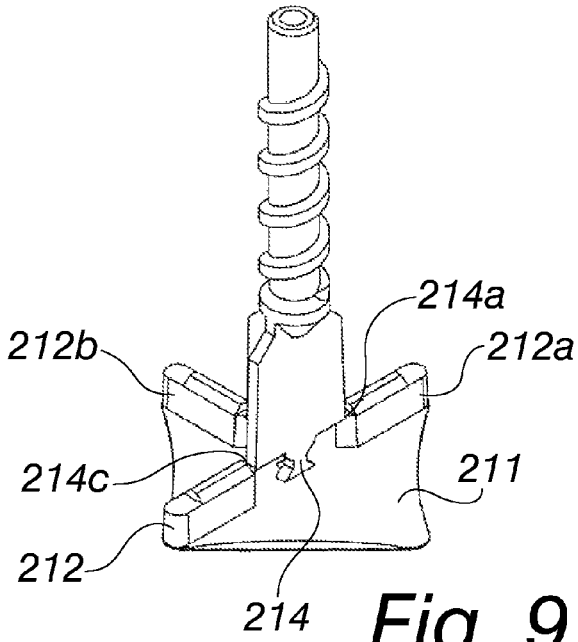

FIG. 9 shows a third embodiment of a base 211, with three spacing protrusions 212, 212*a* and 212*b*, and thus with four breakage points, of which three breakage points 214, 214*a* and 214*c* are visible in FIG. 9, which base is designed to be arranged below the side of a first tile and below two converging corners of a second tile and a third tile.

The spacers 12, 112 and 212 can be produced in different widths, for example from 1 to 10 millimeters, in order to form gaps of the desired width, as well as gaps of extremely reduced width, close to 1 millimeter, the achievement of which normally requires great skill and thus a large amount of time and a high degree of ability on the part of the tile layer.

The ability of the knob 15 to be screwed onto the threaded stem 13 makes it possible to adapt the leveling spacer 10 according to the invention to wall tiles, paving tiles and slabs of thicknesses from 3 millimeters up to 30 millimeters, and possibly thicker, by providing an adapted threaded stem of greater length.

The base 11 with the spacing protrusions 12, and the threaded stem 13 with the wings 17, are made monolithically of plastic material.

Advantageously, the knob 15 can also be made monolithically of plastic material.

The knob 15 is obviously reusable.

In practice it has been found that the invention fully achieves the intended aim and objects.

In particular, with the invention a leveling spacer has been developed which is easy and intuitive to use both in the step of assembly for the immobilization of the tiles, and in the step of removal for the subsequent filling of the gaps, where for both steps it is necessary and sufficient to carry out a screwing operation.

Moreover, with the invention a leveling spacer has been developed which can be used without subjecting the tiles to an unwanted lateral thrust that risks affecting the correct positioning thereof, thanks to the compression effect of the edges of the tiles only in a direction that is perpendicular to the arrangement of those tiles, which is achieved by screwing the knob 15 on the threaded stem 13.

Moreover, with the invention a leveling spacer is provided which can be used without the assistance of specially made utensils, but simply by manually screwing the knob on the threaded stem.

Last but not least, with the invention a leveling spacer is provided for laying wall tiles, paving tiles and the like with the interposition of gaps, that can be made using known systems and technologies.

The invention, thus conceived, is susceptible of numerous modifications and variations, all of which are within the scope of the appended claims. Moreover, all the details may be substituted by other, technically equivalent elements.

In practice the materials employed, and the contingent dimensions and shapes, may be any according to requirements and to the state of the art.

The disclosures in Italian Patent Application No. PD2011A000295 from which this application claims priority are incorporated herein by reference.

What is claimed is:

1. A leveling spacer for laying wall tiles, paving tiles or medium slabs and large slabs with the interposition of a plurality of gaps, comprising:

a base with spacing protrusions for an abutment of the edges of corresponding tiles so as to define a width of the gaps, a threaded stem, which is fixed at right angles to the base in a first central easily breakable point and in a plurality of lateral easily breakable points, each of said lateral easily breakable points being defined by a joint between a spacing protrusion and a corresponding wing which protrudes radially from the threaded stem, a knob for clamping and removing the threaded stem, which comprises a female threaded portion adapted to be screwed to said threaded stem.

2. The leveling spacer according to claim 1, wherein said knob has a flat part for immobilizing edges and corners of a plurality of tiles arranged on said base.

3. The leveling spacer according to claim 1, wherein said knob is provided on the inside with a compartment that is defined so that a body of the knob, in use, does not interfere with the wings that extend from the threaded stem.

4. The leveling spacer according to claim 1, wherein said base has four equidistant spacing protrusions and is designed to be arranged below four converging corners of a corresponding number of tiles.

5. The leveling spacer according to claim 1, wherein said base is provided with two spacing protrusions and three breakage points and is designed to be arranged below two laterally adjacent sides of two tiles.

6. The leveling spacer according to claim 1, wherein said base has three spacing protrusions and four breakage points and is designed to be arranged below the side of a first tile and below two converging corners of a second tile and a third tile.

7. The leveling spacer according to claim 1, wherein said base with the spacing protrusions and the threaded stem with the wings are made monolithically of plastic material.

8. The leveling spacer according to claim 1, wherein said knob can be made monolithically of plastic material.

9. A leveling spacer for laying wall tiles, paving tiles or medium slabs and large slabs with the interposition of a plurality of gaps, comprising:

a base with spacing protrusions for an abutment of the edges of corresponding tiles so as to define a width of the gaps;

a threaded stem, which is fixed at right angles to the base in a first central easily breakable point and in a plurality of lateral easily breakable points, each of said lateral easily breakable points being defined by a joint between a spacing protrusion and a corresponding wing of a plurality of wings which protrudes radially from the threaded stem, the base with the spacing protrusions and the threaded stem with the wings being made monolithically of plastic material;

a knob for clamping and removing the threaded stem, which comprises a body with a female threaded portion adapted to be screwed to said threaded stem, said knob being provided inside the body with a compartment that is defined so that the body of the knob, in use, does not interfere with the wings that extend from the threaded stem.

* * * * *